United States Patent [19]

Nutter

[11] 4,396,872

[45] Aug. 2, 1983

[54] BALLAST CIRCUIT AND METHOD FOR OPTIMIZING THE OPERATION OF HIGH INTENSITY DISCHARGE LAMPS IN THE GROWING OF PLANTS

[75] Inventor: Charles G. Nutter, Woodbury, Minn.

[73] Assignee: General Mills, Inc., Minneapolis, Minn.

[21] Appl. No.: 249,285

[22] Filed: Mar. 30, 1981

[51] Int. Cl.[3] ..... G05F 1/00; H05B 37/02

[52] U.S. Cl. ..... 315/308; 47/17; 47/58; 315/205; 315/DIG. 2; 315/DIG. 4

[58] Field of Search ..... 315/308, DIG. 2, DIG. 4, 315/205; 47/17, 58

[56] References Cited

U.S. PATENT DOCUMENTS

| | | | |
|---|---|---|---|
| 3,514,668 | 5/1970 | Johnson et al. | 315/205 |
| 3,898,643 | 8/1975 | Ettlinger | 364/480 |
| 3,905,153 | 9/1975 | Enter | 47/58 |
| 4,037,148 | 7/1977 | Owens et al. | 315/308 |
| 4,156,166 | 5/1979 | Shapiro | 315/308 |
| 4,196,544 | 4/1980 | Davis et al. | 47/17 |
| 4,275,445 | 6/1981 | Elizaran | 364/480 |

FOREIGN PATENT DOCUMENTS

| | | | |
|---|---|---|---|
| 720279 | 12/1954 | United Kingdom | 315/DIG. 4 |
| 1017009 | 1/1966 | United Kingdom | 315/DIG. 4 |

OTHER PUBLICATIONS

"Know Your Requirement" by Smith & Church Grower, Jul. 16, 1981, pp. 13, 15, 16.

*Primary Examiner*—Harold A. Dixon
*Attorney, Agent, or Firm*—Gene O. Enockson; L. MeRoy Lillehaugen

[57] ABSTRACT

At least one high intensity discharge lamp is utilized in the growing of plants within a growth chamber. The lamp is connected to a power supply that provides pulses of alternating polarity to the lamp through a ballast which first provides a relatively high inductance and which after lamp current has reached a certain level provides a matched T-configured impedance network. Initially, a microprocessor, there being one for each lamp ballast (or one for a group of lamps), closes a switch to connect the lamp to the power supply through a step-up transformer, the secondary winding of which during start-up contributes to the high impedance condition during the early stage of lamp operation and which is thereafter part of the T-network. When the lamp is ionized, both the lamp current and the lamp voltage are sensed. The ballast microprocessor uses the signal derived from the current sensor for the lamp with which it is associated to open the switch and thus remove the high voltage from the particular lamp it controls. Thereafter, the microprocessor, in each instance, causes the frequency of the power supply to be adjusted in discrete steps and to also adjust the inductance of the T-network to effect an optimization of the lamp load. Various temperature and light signals associated with the growing of plants can also be sensed and the microprocessor programmed to correlate these additional signals with the current and voltage signals in providing its optimized control of each lamp within the growing chamber. A supervisory processor or facility computer exercises control over whatever number of individual ballast microprocessors and lamps have been selected for the cultivation of plants within the growth chamber.

47 Claims, 4 Drawing Figures

BALLAST CIRCUIT AND METHOD FOR OPTIMIZING THE OPERATION OF HIGH INTENSITY DISCHARGE LAMPS IN THE GROWING OF PLANTS

BACKGROUND OF THE INVENTION

1. Field of the Invention

This invention relates generally to optimizing the operation of high intensity discharge lamps and the like, and pertains more particularly to a method and circuit for optimizing such lamps in the growing of plants.

2. Description of the Prior Art

Although there are a number of special problems in controlling the artificial lighting utilized in the growing of plants within a growth chamber, some of the individual problems are also present in the control of high intensity discharge lamps and the like for more general illuminating purposes.

In U.S. Pat. No. 3,573,544, granted on Aug. 6, 1971 to Jerome Zonis et al on Apr. 6, 1971 for "Gas Discharge Lamp Circuit Employing A Transistorized Operator" some of the various problems that have been encountered in the past are succinctly set forth. As far as is known to me, these problems have not been effectively solved for commercial installations. The patent explains that a large number of circuits have been proposed for increasing the efficiency of operation of fluorescent lamps. The patent points out that a general approach has been to increase the operating frequency of the signal transmitted to the fluorescent tubes but that there are differences of opinion as to just what the optimum frequency is which will produce the most efficient operation.

It is of importance to appreciate that the above-identified patent stresses the failure of others to deal with the complex variable impedance of gas-filled tubes. In an effort to overcome this shortcoming, the patent being considered provides a well-matched resonant circuit for achieving maximum efficiency with a specific tube; however, the patentees recognize that, while the same circuit will operate other tubes of different size or power requirements, it will not do so as efficiently as for the tube for which it was specifically designed.

The above problem has been recognized in U.S. Pat. No. 3,648,106, issued on Mar. 7, 1972 to Joseph C. Engel et al for "Dynamic Reactorless High-Frequency Vapored Lamp Ballast." In this situation, the patentees explain that it has been discovered that for each particular type of discharge lamp there is a preferred optimum repetition rate of potential application which varies according to the impedance characteristic of the lamp. Therefore, the patentees vary the repetition rate so that the lamp being controlled can find its own preferred mode of operation. In addition to other shortcomings, the main one is that the frequency is not controlled in steps or increments so that both electronic resonance and acoustical resonance cannot occur.

In U.S. Pat. No. 3,710,177, issued on Jan. 9, 1973 to Richard Ward and titled "Fluorescent Lamp Circuit Driven Initially at Lower Voltage and Higher Frequency, " after ionization has occurred, the patentee recognizes that the frequency can be progressively reduced or done so in a step-wise fashion. The patent further explains that the switching can be controlled manually or by a sensing device. However, once the switching has been achieved, the lamp operation is continued without further step-wise control of the frequency. Thus, there is no optimization of the fluorescent lamp dealt with in this patent. While optimization can be important in controlling fluorescent lamps, it is extremely important in controlling high intensity discharge lamps, as will be considered in the paragraph below.

A bank of series-connected fluorescent lamps are energized by a power triode in U.S. Pat. No. 3,876,907, granted on Apr. 8, 1975 to Don F. Widmayer for "Plant Growth System." However, only relatively small current magnitudes are involved. Also, there is no attempt to control the amount of power to the fluorescent lamps by varying the current pulse width with a concomitant "hard" or fast fully on-fully off switching action. The system is relatively inefficient and would not be suitable for high intensity lamps in the 400–1000 watt range where relatively large current values are used.

SUMMARY OF THE INVENTION

Accordingly, an important object of the present invention is to optimize the control of gas discharge lamps, especially high intensity discharge lamps, in the growing of plants in a growth chamber.

Another object is to control a high intensity discharge lamp for all operating conditions, doing so under various load conditions even though the load conditions are of an extremely dynamic or transient nature.

Another object of the invention is to correlate various types of operating data and to accomplish the correlation very rapidly so that corrective measures can be taken.

Another object is to provide an effective energy management of a high intensity lamp, or a plurality of lamps, with a concomitant increase in its, or their, overall efficiency.

Still another object of the invention is to prevent damage to not only the lamp but also the electronic components associated therewith. More specifically, an aim of the invention is to eliminate resonance, both of an electrical character as far as the electronic components are concerned and also of an acoustical nature as far as the lamp itself is concerned.

Yet another object of the invention is to effect automatic switching from the starting mode to the operating mode of the lamp.

Closely allied with the preceding object is the object to realize a rapid lamp warm-up. In other words, a high or peak current can be beneficially utilized when the lamp is cold. After the lamp has had time to warm up, there is an automatic decrease of the current to an optimum operating level.

Also, the invention has for an object the increase of the duty cycle of the power supplied to the lamp, the duty cycle being progressively increased to whatever figure is most appropriate for continued operation after the initial start up has taken place.

Still further, an object of the invention is to provide a ballast circuit that can employ low cost components in that tolerances are not as important as in prior art systems, for my system automatically adjusts for specific operating conditions that are encountered, doing so without requiring precise parameters or tolerances.

In view of high intensity discharge lamps possessing dynamic characteristics that change quite rapidly, it is within the purview of the invention to utilize a microprocessor that can be controlled to correlate various operating conditions and cause a corrective action to be immediately taken which will effect an overall optimum operation of the lamp or lamps.

The invention has for still another object the control of lamps utilized in the growing of plants, doing so so as to take into account various conditions that are experienced within the growth chamber. In this regard, while various means have been devised for controlling the ambient temperature within a growth chamber, still it is highly desirable that the lamps themselves be adjusted as far as their light output is concerned so as to not only increase unduly the ambient temperature within the growth chamber, which increase can produce a deleterious effect on the plants, but to make certain that the lamps themselves are not damaged and also that the circuitry associated with the lamps, such as the power supply, is not adversely affected. Also, it is within the purview of the invention to control the temperature of the water jacketing the lamp, when present, the system in such a situation making an automatic adjustment, such as reducing the power to the lamp, reducing the temperature of the cooling water, or increasing the flow of cooling water, all in accordance with whatever program has been selected. Even more importantly is the shutdown that can be immediately realized should there be a complete loss of cooling water.

Still further, it is within the contemplation of the invention to utilize a facility computer which will exercise supervisory control over the various ballast microprocessors associated with the individual lamps contained in a growth chamber. For instance, the light being furnished by high intensity lamps may supplement natural daylight; my system can be programmed to assure that the light level within a growth chamber remains constant (or adjusted at various intervals to a prescribed level) independently of the amount of available sunlight passing through light-transmissive panels. Hence, my invention possesses considerable versatility which will make it exceedingly valuable in the control of lamps utilized in the promotion of plant growth.

Another object, along the lines of the preceding object, is to utilize a supervisory or facility computer that can exercise control over various groups of microprocessors, utilizing an execution program that will cause one group to perform according to one schedule, a second group according to another schedule, and so on. For example, a time-sharing system can be readily devised in which cetain microprocessors and the lamps controlled thereby can be assigned a higher priority program than others.

Briefly, my invention envisages a T-configured matching impedance network that is connected between the power supply providing current pulses of alternating polarity and the high intensity discharge lamp, the T-network having its inductance automatically adjusted for whatever operating conditions exist at any given time so as to provide an optimum lamp control. First, however, only inductive reactance is employed in the ballast circuit to provide a high impedance during lamp start-up; the T-network becomes effective after a predetermined lamp current has been established. Initially, though, provision is made via a microprocessor, there being either one for each lamp or microprocessor, or time-shared by a group of several lamps, for causing one inductance component of the network to impress on the lamp with which the microprocessor is associated a high voltage spike which causes ionization of the lamp. A current sensor immediately provides a signal back to the microprocessor that informs the microprocessor that the arc has been struck. This results in an opening of the switch that was closed in providing the initial high voltage spike.

The current-derived signal is utilized for changing the frequency or repetition rate of the alternating pulses and to connect a capacitor into the ballast circuit at the proper lamp current so that the resulting T-network is tuned in such a way that there is never any electrical resonance which could damage, or even destroy, the power supply comprised of semiconductor switches or cause acoustical resonance within the high intensity discharge lamp. At the same time, by way of a saturable core reactor, the impedance of the inductance of the T-network is changed so as to control the average current being supplied to the lamp. In this way, the microprocessor can be programmed to maintain a high current to the lamp during a warm-up period immediately following the ionization of the lamp via the high voltage spike. At an appropriate time, the current can be reduced and either a constant current supplied to the lamp or constant power transferred to the lamp from the power supply.

In addition, external factors can be taken into consideration and utilized by the microprocessor in effecting an optimum control of the lamp load for various conditions that are encountered, either within the lamp itself or in the growth environment in which the lamp is located. In this latter regard, it will be appreciated that when growing plants under artificial light, various temperature and light conditions must be considered and when practicing my invention such factors can be automatically taken into account through the agency of the ballast microprocessor for each lamp and the lamp controlled by the microprocessor in such a manner that it will be operated most effectively for whatever conditions are to be realized.

It is within the purview of my invention to utilize a facility computer, which can constitute a centrally located microprocessor, to provide a supervisory or executive control of whatever number of lamp ballast microprocessors are used for a given growth chamber installation.

Thus, my system provides an optimum control of the lamp or lamps for various transient or dynamic happenings that would otherwise result in an operational control that is not fully optimized. Also, the use of a facility computer or master microprocessor enables a plurality of lamps to be adjusted uniformly en masse, or specific combinations or groups of lamps to be adjusted.

BRIEF DESCRIPTION OF THE DRAWINGS

FIG. 1 is a side elevational view of a growth chamber incorporating my invention therein;

DESCRIPTION OF THE PREFERRED EMBODIMENT

Figure 7:
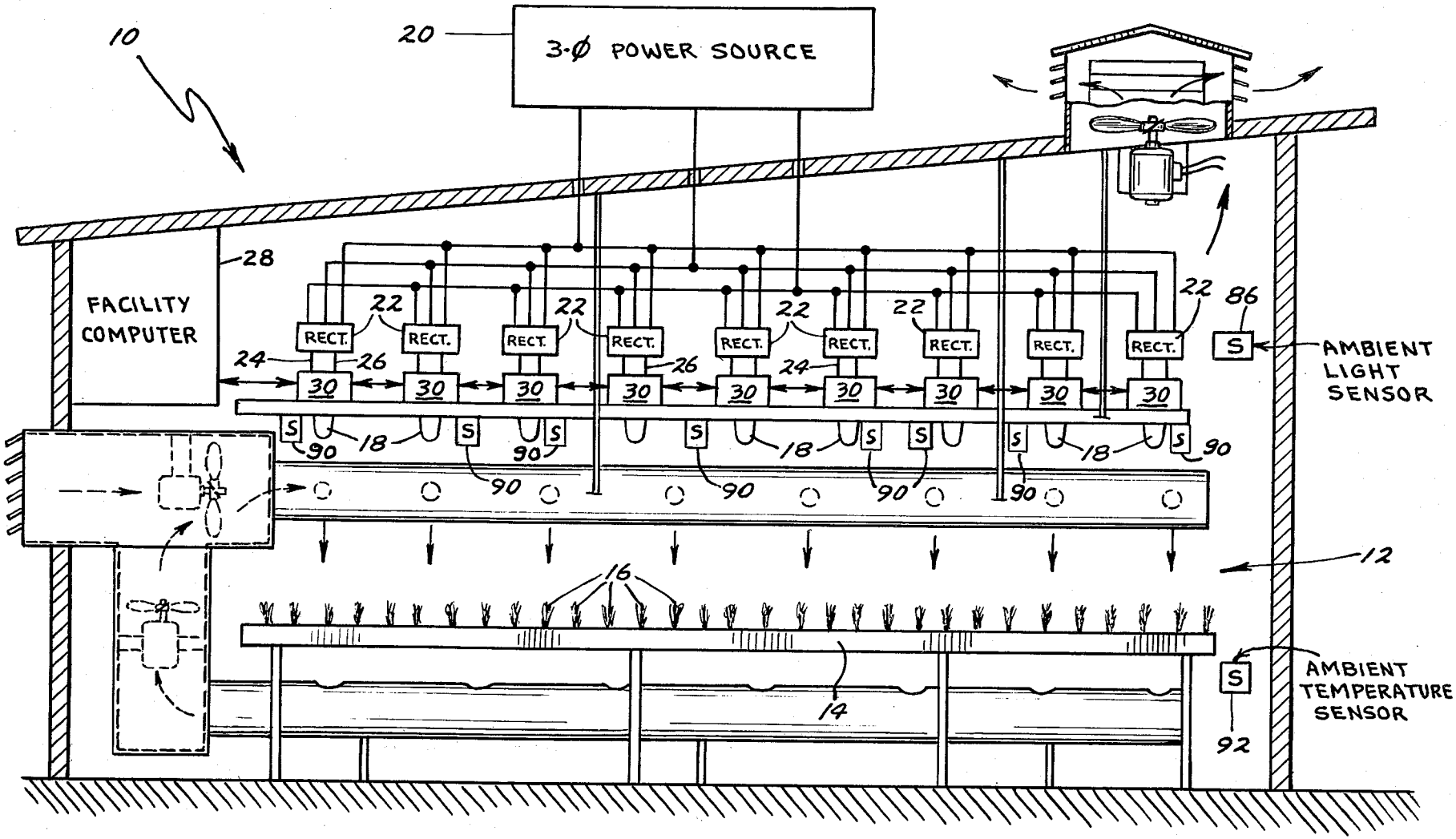

FIG. 1 shows a typical building denoted generally by the reference numeral 10 and containing therein a growth chamber 12. Within the growth chamber 12 is a large tray containing a plurality of plants 16. Actually, when commercially growing the plants 16, the tray 14 would be comprised of a number of individual trays which would be advanced from one end of the chamber 12 to the other end. The growth chamber 12 is more fully described in U.S. Pat. No. 4,196,544 issued on Apr. 8, 1980 to Noel Davis et al for "Apparatus and Method for Controlling Plant Growth with Artificial Light," the patent being assigned to the same assignee as the present invention.

It is important to note that a plurality of high intensity lamps 18 are included in the growth chamber 12. These lamps are more fully described in U.S. Pat. No. 4,196,544, supra. It should be apreciated, though, that each lamp 18 inludes an inner bulb or tube and an outer globe, water flowing through the space therebetween, all as explained in said U.S. Pat. No. 4,196,544.

It is also important to understand that the lamps 18 must be appropriately energized so as to provide the requisite illumination for the various plants 16, thereby encouraging their growth while moving through the chamber 12. Where a large number of lamps 18 are utilized, only a relatively few appearing in FIG. 1, it becomes extremely critical that the various lamps be operated in an optimum fashion. If not, damage can occur to the lamps as a result of acoustical resonance. As far as the power supply is concerned, it being of a semiconductor character, electrical resonance can overload the power supply with a concomitant damage to the components. Of course, where a large number of lamps are operated, it becomes extremely important that the utmost in efficiency be realized, for any unnecessary power simply runs up the cost of raising the plants 16 to maturity.

Superimposed on FIG. 1 is a three-phase power source or supply 20, more specifically, a three-phase distribution grid. Connected to the power supply 20 are a number of rectifiers 22 for converting the three-phase power to direct current, there being one such rectifier for each lamp 18. The rectifier 22 in each instance has a +V main 24 and a −V main 26, these mains 24, 26 also appearing in FIG. 2. Also shown in FIG. 1 is a supervisory processor or facility computer 28. More will be said hereinafter concerning the role played by the facility processor or computer 28.

Figure 2:
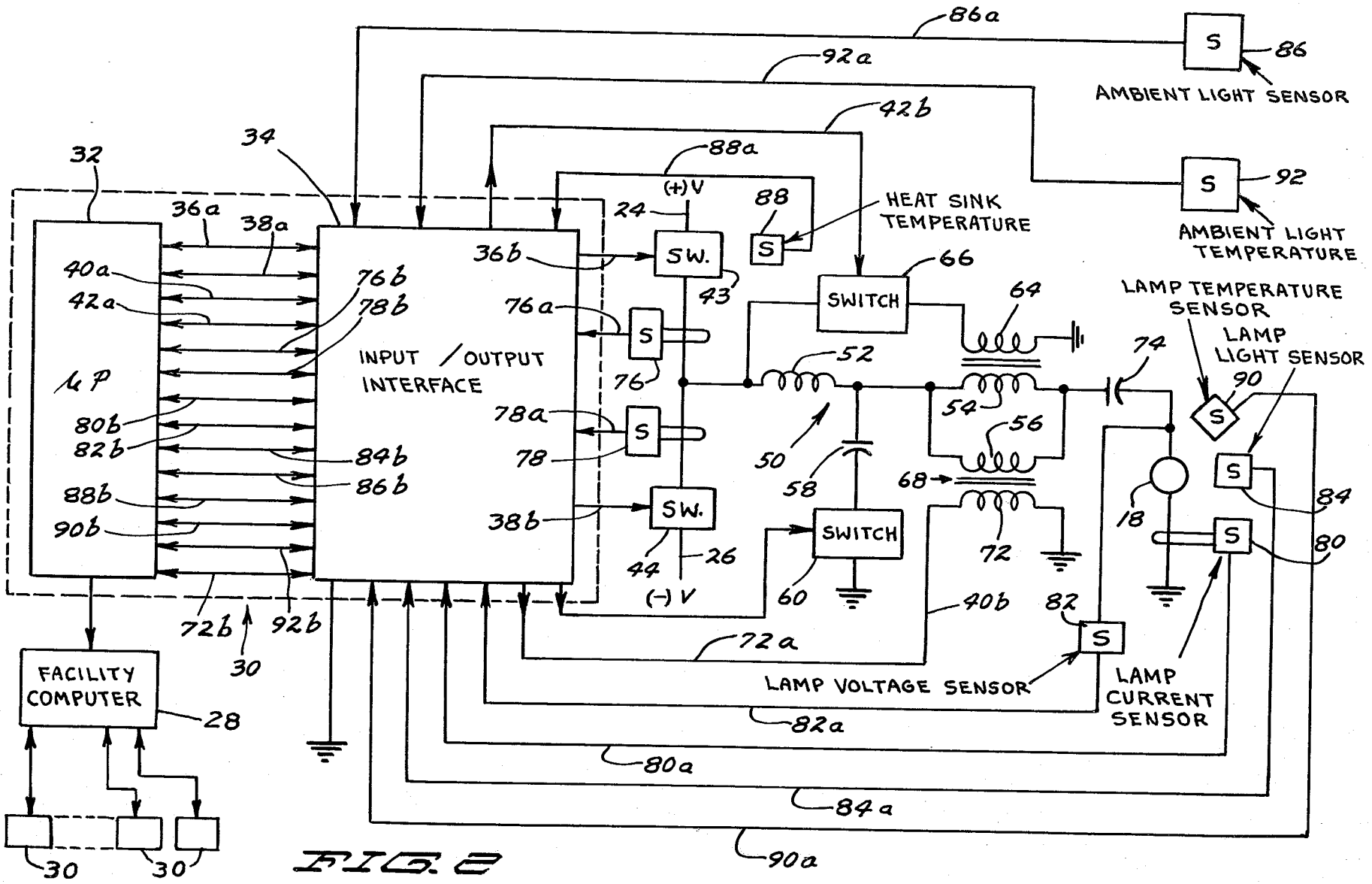
FIG. 2 is a combined block and schematic diagram illustrating one form my ballast circuit can assume in effecting an optimum operation of the lamps depicted in FIG. 1, and FIGS. 3A and 3B constitute a flow diagram illustrating one set of procedures that can be employed in realizing an optimum control of the lamps within the growth chamber of FIG. 1.

At this time, attention is directed to a number of individual lamp control units, each being identified by the reference numeral 30 in FIG. 1 and also in FIG. 2. In order to provide a constant control for each lamp 18, what might be termed a ballast microprocessor 32 is included in each of the units 30. The word "ballast" is used to distinguish from the term "supervisory" for the computer 28. A suitable microprocessor is the MC146805E2 microprocessor unit manufactured by Motorola Semiconductor Products, Inc. 3501 Ed Bluestein Blvd., Austin, TX 78721. This microprocessor 32 is an 8-bit fully static and expandable microprocessor containing a central processing unit, an on-chip RAM, input/output logic and timer. Inasmuch as data sheets can be obtained directly from Motorola Semiconductor Products, Inc., it is not believed necessary to go into further detail as far as the microprocessor 32 is concerned. Since analog signals will be derived, a sensory interface or input/output controller 34 is employed to monitor certain events still to be described and convert the analog signals to digital signals that can be delivered to the I/O logic of the ballast microprocessor 32. Similarly, the digital output values from the microprocessor 32 must be converted to appropriate analog signals. Therefore, a suitable input/output interface or controller 34 is employed. An example of such interface or controller 34 is Motorola's Asynchronous Communication Interface Adapter (ASCIA). To facilitate an understanding of the manner in which data is processed, output control lines to the interface 36 have been assigned the reference numerals **36*a*, 38*a*, 40*a* and 42*a*, whereas the output control lines from the unit 34 have been labeled 36*b*, 38*b*, 40*b*, and 42*b***.

At this time, it should be noted that the output lines **36*b* and 38*b* lead to semiconductor switches 43 and 44 constituting a driver for the ballast circuitry. The switches 43 and 44, it will be observed, are connected to the earlier-mentioned +V and −V mains 24 and 26. The switches 43 and 44** constituting the driver provide current pulses of alternating polarity. More specifically, the driver constitutes four power transistors which are arranged to be diagonally driven in the supplying of the alternating polarity current pulses. Such an arrangement of transistors is shown and described in U.S. Pat. No. 3,648,106, supra.

Performing a very important function in realizing an optimum lamp control is a T-configured impedance network 50 composed of a first inductance or coil 52, parallel inductances or coils 54 and 56, these two inductances 54, 56 being in parallel with each other but in series with the inductance or coil 52, and a capacitor 58 connected at one side to the junction of the inductances 52, 54 and 56 and to a gated or triggered switch 60, the switch 60 connecting the other side of the capacitor 58 to ground when closed. In other words, the T-network 50 exists when the switch 60 is closed. More specifically, the T-network then is composed of a first leg constituting the coil 52, a second leg composed of the two parallel coils 54, 56 and a third leg constituting the capacitor 58. The switch 60 is opened and closed by a signal transmitted over the output line **40*b* when the microprocessor provides a control signal via the input line 40*a***.

Inductively associated with the inductance or coil 54 is a primary or control winding 64. The control winding 64 is in circuit with a bi-directional switch 66 which is gated into an open or closed position via the previously mentioned output line **42*b***.

At this time, a saturable core reactor 68 will be mentioned, having the previously mentioned inductance or coil 56 as its main or power winding. The inductance 56 is connected in shunt or parallel with the inductance 54, as already explained. The reactor 68 also has a control winding labeled 72 which is connected to the interface 34 via an energizing line **72*a* and from the interface 34 to the microprocessor via a control line 72*b*. The junction of the coils or windings 54 and 56 is connected to a coupling capacitor 74. The other side of the capacitor 74 is connected to the lamp 18 shown in FIG. 2, being one of the plurality or bank of such lamps 18 shown in FIG. 1. The other side of the lamp 18** is connected to ground.

Having presented the foregoing description, various sensors will now be referred to. The first sensor carries the reference numeral 76 and senses the current supplied by the semiconductor switch 43. In this regard, a line **76*a* extends from the sensor 76 to the interface or controller 34; an input line 76*b* extends from the interface 34 to the ballast microprocessor 32. In a similar manner, a current sensor 78 provides a signal representative of the current supplied by the other semiconductor switch 44. In this regard, an input line 78*a* extends from the sensor 78 to the interface 34 and a second line 78***b* extends from the interface 34 to the microprocessor 32. The function of the two sensors 76 and 78 is to make certain that the current pulses of alternating polarity supplied to the T-network 50 do not overload the switches 43, 44 constituting the driver. Attention is now directed to still another current sensor 80 which provides an analog voltage signal representative of the current flowing through the lamp 18. Thus, there is an input line 80*a* leading to the interface unit 34 and another line 80*b* connecting the unit 34 to the microprocessor 32.

It is intended that the voltage across the lamp 18 must also be sensed and to accomplish this a voltage sensor 82 is employed. Its signal is conveyed over an input line 82*a* to the interface unit 34 and then to the microprocessor 32 via the line labeled 82*b*. By sensing both current and voltage, the microprocessor 32 can be programmed so that the lamp 18 is operated in a constant wattage mode.

My ballast circuitry lends itself readily to the processing and correlating of miscellaneous data. Therefore, a lamp light sensor 84 is utilized. Such a sensor can deliver a signal via the input line 84*a* to the interface unit 34 and then after conversion by the interface unit 34 fed over a line 84*b* to the microprocessor 32. Similarly, as can be seen from FIG. 1, there is an ambient light sensor 86 within the growth chamber 12; the sensor 86 also appears in FIG. 2. The analog signal from the ambient light sensor 86 is delivered to the interface unit 34 over a line 86*a* and from the interface unit 34 to the microprocessor 32 via the additional line 86*b*.

Still further, temperature parameters can be processed when practicing my invention and with this in mind the temperature of the switch 43 is sensed by means of a temperature sensor 88 for the purpose of ascertaining when the temperature, if it does happen, reaches an unacceptable high limit. In this instance, an input line 88*a* extends from the temperature sensor 88 to the interface 34, a line 88*b* extending from the unit 34 to the microprocessor 32. Associated directly with the lamp 18 of FIG. 2 and each of the lamps 18 of FIG. 1 is a lamp temperature sensor 90 which provides a voltage signal representative of lamp temperature over a line 90*a* extending to the interface 34 and over a line 90*b* extending from the interface 34 to the microprocessor 32. Still further, an ambient or air temperature sensor 92 is employed within the growth chamber 12, it providing a signal indicative of the temperature within the growth chamber 12 by means of an input line 92*a* to the interface unit 34 and a line 92*b* from the interface unit 34 to the microprocessor 32.

What should be appreciated at this stage is that the microprocessor 32 can correlate the various signals received from the different sensors and exercise a degree of control commensurate with the information contained in these signals. It should be recognized that some of the parameters usually change slowly, such as temperature and also light, but that conditions involving current and voltage usually change quite rapidly. However, should there be, say, a loss of cooling fluid for any lamp 18, then there would be an abrupt increase in temperature; nonetheless, the microprocessor 32 for each lamp 18 can be programmed to immediately shut off the power to that particular lamp 18, or when cooling fluid is being supplied to a bank or group of lamps to the entire group, either through the agency of each ballast microprocessor or the supervisory facility computer 28.

It should be appreciated that the microprocessor 32 in each instance, supervisorily assisted if need be by the facility computer 28, is programmed to process any or all of the information contained in the signals supplied from the various sensors just described. Where circumstances dictate, the microprocessor 32 provides immediate signals from the feedback information it has received and changes the control it exercises over the switches 43 and 44 in a manner more fully described in the operation presented below in conjunction with the exemplary flowchart set forth in FIGS. 3A and 3B.

Additionally, various time-sharing arrangements can be realized. In this regard, the facility computer 28 can control various groups of control units 30, more specifically the microprocessors 32 contained therein (there being one microprocessor in each unit 30) so that one group of microprocessors 32 and the lamps 18 controlled thereby follow one operational pattern and other groups follow modified programs. For instance, the plants 16 need not all be the same, and light conditions can be varied to suit the particular plant variety at different locations within the growth chamber 12. Light can be varied, when utilizing my system, to accommodate various degrees of maturity. In some cases, 1000 watt lamps may be used in one section of the chamber 12 and 400 watt lamps in another section. Although individual microprocessors can be programmed in accordance with the type of lamp it is to control, the facility computer enables a higher priority program to be substituted when circumstances dictate.

Other reasons exist for a flexible time-sharing program that is easily realized when practicing my invention. Thus, it should be recognized that the system herein described is exceedingly versatile, being adaptable to automatically and expeditiously handling various requirements.

Figure 3A:
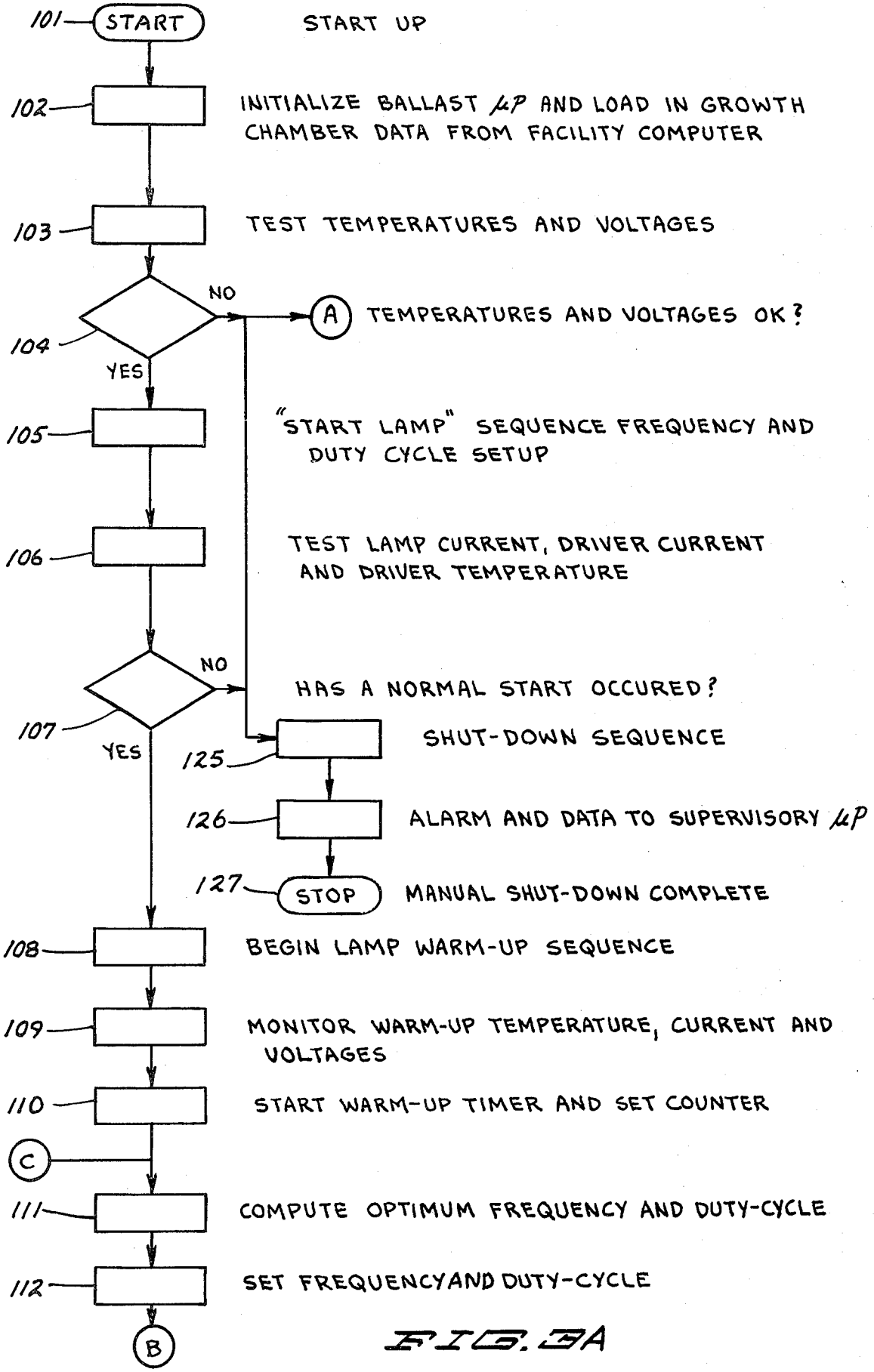
Figure 3B:
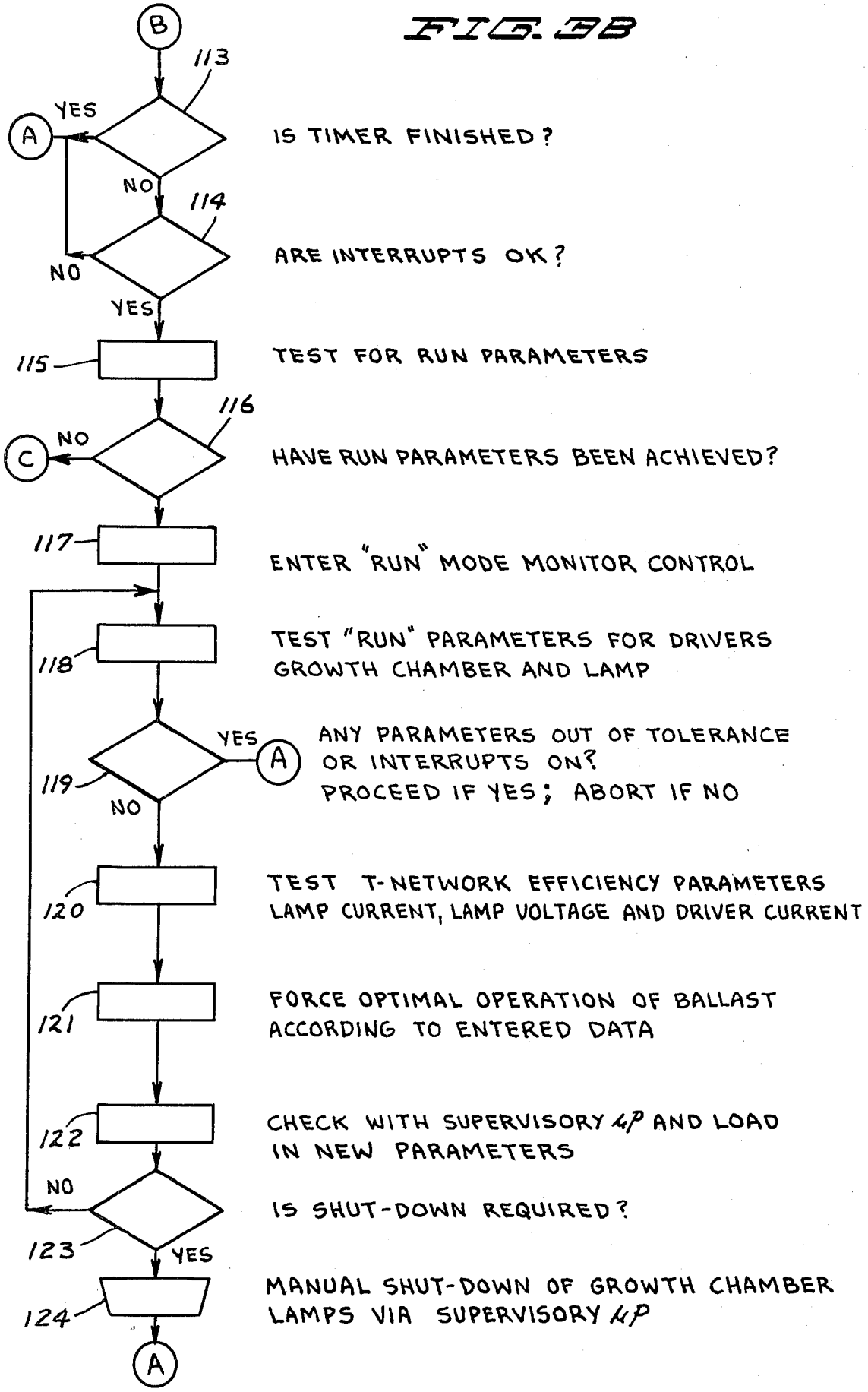

Basically, the flowchart comprising FIGS. 3A and 3B involves the initial or starting of a typical program with various checks as to initial and subsequent operating conditions, both as to current, voltage, light and temperature. Precautionary measures are continuously taken with respect to adverse operating conditions. Some of the programming procedures will be dealt with when discussing a typical operation of the bank of lamps 18 in FIG. 1 and the single lamp 18 in FIG. 2. With the foregoing disclosure in mind, the illustrative procedures are believed to be well within the capabilities of a programmer of ordinary skill in the art so that various logic steps could be implemented by such a programmer to take care of operating conditions and contingencies not herein fully detailed or expressly dealt with, especially when taken with the operational sequence now to be considered in conjunction with the flowchart of FIGS. 3A and 3B.

OPERATION

Assuming that the three-phase power source 20 is connected to the various rectifiers 22 and that a positive voltage is applied to the main 24 and the negative voltage to the main 26, then my circuitry is preliminarily conditioned for operation. First, however, it will be explained that the operation will be largely described with respect to the single lamp 18 appearing in FIG. 2. Reference should now be made to FIG. 3A. The first functional block in the flowchart after the start block 101 is the block or step labeled 102. The step 102 dictates that the microprocessor 32 be initialized and that various data contained in the facility or supervisory computer 28 concerned with the growth of plants and the optimum operation of the growth chamber 12 be loaded into the microprocessor 32 for each lamp 18. Consequently, it is during this function that the facility computer 28 can load in the initial parameters for lamp operation and start the start-up sequence for ionizing and preparing the lamp circuit for lamp warm-up. Once all data has been loaded into the memory for each microprocessor 32, tests can be made of the temperatures and voltages present at the ballast site and in the ballast hardware. This occurs at step 103.

Decision block or step 104 determines if there are any out-of-tolerance voltage or temperature conditions. If there are none, the program advances to step 105. Step 105 is the beginning of the start lamp sequence. During this period, the frequency and duty cycle are set up specifically for starting the lamp 18. Then, lamp ionization is attempted.

The lamp 18 in FIG. 2 cannot be energized or started until the bi-directional switch 66 is closed which happens when a signal is forwarded from the microprocessor 32 over the line 42*b* leading from the interface unit 34 to the bi-directional switch 66, as happens in step 105 of FIG. 3A. This signal causes the switch 66 to be closed with the consequence that alternating current pulses from the semiconductor switches or drivers 43 and 44 are passed through the primary or control winding 64 of the transformer comprised of the inductance or coil 54 and the primary or control winding 64. Since the number of turns or convolutions is greater in the inductance or coil 54 as contrasted with those contained in the primary or control winding 64, a step-up transformer action is produced which applies a high voltage spike to the lamp 18 through the coupling capacitor 74. The capacitor 58 is not in the circuit at this time, as the switch 60 is open. By having the switch 60 open during start-up, only the inductances 52, 54 and 56 are utilized to provide a relatively high initial inductance or impedance.

The frequency is set during start-up for a relatively high frequency, typically 25 KHz or higher. The duty cycle slowly ramps up incrementally adding energy to the wave form until such time that sufficient wave form width occurs at the lamp 18 to cause ionization.

It must be noted that it is possible to have a frequency that could cause the T-network 50, which comprises the inductances 52, 54, 56 and capacitor 58, to produce a resonant condition that would cause a current to be developed that would destroy the driver 43, 44. To avoid this condition, part of the start-up sequence embodied in step 105 is to abruptly step up the frequency (or abruptly step down the frequency) to a point where resonance is avoided and is not a factor which would overstress the drivers 43 and 44 due to high current. Additionally, the switch 60 is kept open during this stage so as to remove the capacitor 58, thereby causing only the series inductance provided by the components 52, 54, 56 to be in the circuit.

Once ionization has occurred, the program moves to step 106 where lamp current is tested. More specifically, as soon as a flow of current is established through the lamp 18, the current is sensed by the sensor 80. Also, the driver currents are monitored via the sensors 76 and 78.

If a normal start has occurred, decision block or step 107 allows the program to proceed. Decision block 107 denotes that lamp current, driver current and certain other parameters have been tested to determine if it is proper to proceed with the warm-up sequence. The driver temperature determined by the sensor 88 must not exceed a temperature specified by the manufacturer of the transistors or other semiconductor devices used for the driver because if the temperature exceeds such a limit or parameter, damage could result should the attempted operation be continued. If for some reason there is not a normal amount of lamp current flowing into the lamp 18 following ionization, the chances of the lamp 18 warming up normally would be very slim, since either there is trouble with the driver 43, 44, or the lamp has failed or is defective. If for some reason the RMS driver current is very low, a current that does not compare favorably with the indicated lamp current, it could mean that the duty cycle, which in pulse systems is defined as the ratio of the sum of all pulse durations to the total period during a specified period of continuous operation, is not progressing and consequently not getting sufficient initial lamp current for warm-up. Indicated lamp current is controlled at that current recommended by the manufacturer of the lamp 18 for proper warm-up of the lamp. It should not exceed a specific amount, nor should it be lower than a certain amount, to achieve optimum warm-up results.

A specific case might involve a 1000 watt high pressure sodium lamp such as that manufactured by the General Electric Company. Once the decisional step represented by block 107 has indicated that a normal start-up has occurred, the sequence step represented by block 108 is initiated. This immediately causes the processor 32 to output a signal to open the bi-directional switch 66 so that further high voltage pulses or spikes are not impressed across the lamp 18. At this time, additional pulse width is allowed with respect to the current pulses being supplied from the driver 43, 44; also the magnitude of the current may rise while the frequency is shifted to a lower level.

When the warm-up sequence denoted by block 108 is established, the logic symbolized by block 109 inaugurates a complete monitoring of functions so that temperatures, currents and voltages can be tested for out-of-tolerance conditions. The block labeled 110 starts a warm up timer and set counter. This step is included because during the lamp warm-up loop, should for some reason a proper lamp warm-up not occur within a reasonable time, such a happening may very well indicate that it is not going to occur, or that there are serious problems with the lamp 18 or driver 43, 44, or both. Next, the sequence of block 111 is started. Thus, the optimal frequency and duty cycle computational subroutine begins, the computation being in accordance with the optimum frequency and duty cycle that have been previously selected by reason of the particular programmed parameters that have been loaded into the memory of the microprocessor 32. This causes the step of block 112 to be initiated, thereby setting the duty cycle and frequency.

After the duty cycle and frequency have been properly established, the timer will be allowed to time out with the consequence that decision block or step 113 informs the facility computer 28 to shut down the lamp 18 by way of a command from the microprocessor 32 associated with this particular lamp 18 and load any data furnished during a normal maintenance scan of the various ballast circuits by the ballast microprocessors 32. The shut down sequence and alarm steps will be referred to hereinafter.

If the timer is not timed out, resort is made to block 114 where interrupts are tested. The various interrupts are low line voltage information, emergency information from the facility computer 28, and other parameters that might prove damaging to further operation of the lamp 18 which can be an on/off contact or whatever kind of inputs to the microprocessor are defined as interrupt inputs.

If there are no interrupts forcing an abort operation, then we proceed to block 115. Block 115 tests for the run parameters. If during the warm-up sequence, certain run currents, temperatures, voltages, power levels, have been achieved, then the warm-up sequence should end. Decision block 116 asks the question, have the run parameters been achieved? If yes, then the program proceeds to the block 117 titled, enter run mode monitor control. If the run parameters have not been achieved, then the program returns to step or block 111 and the start-up sequence is restarted. If, for some reason, in the loop around from block 116 to block 111 the timer has timed out, then it is an indication that the ballast should be shut down according to the requirements established by block 113. Once in the enter/run mode, as determined by the monitor and control block 117, the subroutines, which call for testing the run parameters, are loaded. Block 118 then performs the tests on the various run parameters which include light levels near the lamp 18, light levels in the growth chamber 12, temperature of the driver 43, 44, temperature of the lamp 18, temperature of the chamber 12, driver currents, lamp currents, driver voltages, lamp voltages, and if desired, line voltages.

After all these measurements have taken place, decision block 119 asks if any of these parameters are out-of-tolerance for the run condition, or if any interrupts have been received. If the answer is yes, then the ballast run is aborted. If the run parameters are being met and the answer is no, and the tolerances are normal, then we proceed to step 120. It is during step 120 that the network efficiency parameters involving lamp current, driver current, lamp voltage, and other ancillary parameters related to network evaluation come under careful comparison with what is regarded as the optimum efficiency scheme for operating the network 50. Once these tests are made, block 121 forces the optimal operation of the ballast which involves shifting duty cycle or frequency, or both, so that the optimum efficiency can result. Also, if there is any data entered from the facility computer 28 that might dictate a different operating current for some reason, this can be taken into account and appropriate action taken.

Once block 121 is complete, block 122 allows a check-in with the facility computer 28 and the loading of new operating parameters. Whether a shut down is required is determined by step 123. If yes, a loop around to block 118 allows the delineated test step to reestablish control under any new parameters and move through the run sequence algorithm once again. A signal from the sensor 80 being representative of lamp current is fed to the microprocessor 32 through the interface unit 34.

In addition to the high initial impedance, it is also intended that during start-up or ionization of the lamp that a relatively high frequency current be supplied. Therefore, the microprocessor 32 is programmed so as to have the switches 43 and 44, that is the driver, provide alternating current pulses at a high repetition rate during the initial starting of the lamp 18. Once the flow of current is sensed, however, then the microprocessor 32 reduces the repetition rate or frequency of the alternating current pulses being supplied by the driver composed of the switches 43 and 44. Solely as an illustration, the starting frequency, as already indicated, can be on the order of 25 KHz and is lowered to a programmed frequency of perhaps 16 KHz. The specific frequencies are not important. What is important is that the various frequencies, and there can be any number of them, are stepped from one frequency value to another rather than progressively changed. In other words, there is not a steady or progressive decrease from the 25 KHz to the 16 KHz (or whatever frequencies are selected). Instead, there is an abrupt change or step-wise change from the higher frequency to the lower frequency. It is important to appreciate, though, that the frequencies, even though stepped, are selected and programmed into the memory of the microprocessor 32 so as to avoid any electrical resonance and also any acoustical resonance in the lamp 18. Either of these resonant conditions could have the effect of overloading the semiconductor switches 43, 44 or destroying the lamp 18. Overloading of the semiconductor switches 43, 44 is also prevented by reason of the current sensors 76 and 78, and even the temperature sensor 88 that is in a thermal transfer relation with the heat sink of the switches 43, 44.

Consequently, at the beginning, the inductance provided by the T-network 50 (the capacitor 58 being removed) is quite high. Once current is sensed via the current sensor 80, however, then the microprocessor 32 is programmed to provide through the interface 34 a suitable current signal that is fed over the ine **72*a* to the control winding 72 of the saturable core reactor 68. This control current can be sufficient so as to reduce the inductance of the main power winding 56. Hence, the lower inductance of the main power winding 56 of the saturable core reactor 68 and the fixed relatively low inductance of the coil 52 of the T-network 50 assures that a relatively high lamp current can be supplied to the lamp 18. In other words, the duty cycle at the time the lamp is ionized can be quite low but rapidly increased once a current flow has been sensed through the lamp 18. The increased current can be maintained at a relatively high level until the lamp warms up. It has already been mentioned that a temperature sensor 90 is in a proximal relation with the lamp 18 and any increase in temperature is reflected in the signal delivered to the microprocessor via the interface 34. Hence, corrective action can be taken to lower the current, that is reduce the duty cycle again after the lamp 18 has warmed up sufficiently. The point to be appreciated is that the lamp 18** can be brought up to its normal operating temperature quite rapidly when utilizing the ballast circuit constructed in accordance with my invention.

It should be recognized that there are rapid changes at times with respect to the current flowing through the lamp 18. Inasmuch as these changes are immediately sensed by both the sensores 80 and 82 with the consequence that suitable signals are delivered to the microprocessor 32, an optimum operating condition can be constantly maintained. This is in addition to the safeguards that the frequency is stepped to various values that have been preselected so as to avoid both electrical and acoustical resonance.

More specifically, it should be explained at this time that there will be a continual searching for a lamp current that will provide a current through the lamp 18 that is appropriate for the particular conditions. The current through the lamp 18 is continuously monitored and adjusted by reason of the optimum tuning or matching between the lamp 18 and the power supply or driver composed of the switches 43 and 44. Consequently, there can be, if desired, a maximum transfer of power from the power supply 43, 44 to the lamp 18 or there can be a control of the current so as to vary the power in accordance with desired results. Consequently, a true optimization of the lamp's operation is continuously provided. Not only that, but the components constituting the T-network 50 need not be accurately selected as to their ratings or values, for the sensing action that is utilized will compensate for relatively wide deviations. Stated somewhat differently, the components constituting the T-network 50, that is the inductances 52, 54 and 56, as well as the capacitor 58, can be obtained at a lower cost when they need not be precisely fabricated. Furthermore, if there is any lamp deterioration, the sensor 84 associated directly with the lamp 18 will cause the microprocessor 32 to either make an appropriate adjustment, or if the lamp 18 should become extinguished and not usable, then it can provide a signal to that effect. Also, any change in ambient light within the growth chanber 12 can be compensated for by the sensor 86 and the signal it furnishes to the microprocessor 32. Consequently, the growth chamber 12 can operate with natural light, assuming that suitable windows are provided, and the various lamps 18 turned completely on, or just partially on, to supplement or replace the sunlight.

The facility computer 28 exercises supervisory control over the various individual lamp control units 30, each of which contains a microprocessor 32. Hence, the central processor 28 can be programmed to disconnect any one of the lamps 18 in the growth chamber 12. It should be borne in mind that a relatively large number of lamps 18 are utilized and sometimes power station requirements dictate tht the overall load on its system be reduced. The central processor or facility computer 28 enables the automatic disconnection of some or all of the lamps from the three-phase power source 20, which normally is a distribution line belonging to a power grid. Stated somewhat differently, any one or group of the lamps 18 can be dumped so as to lighten the electrical load when a power company's peak load so requires. Yet, until that happens, the operation of each lamp 18 is optimized in accordance with the program contained in the memory of each microprocessor 32, there being one associated with each lamp control unit 30 as already explained.

A manual shut down can be performed via the block 124, this step to be initiated whenever the lamp 18 is to be intentionally turned off. It will be noted that block 124 connects with the blocks 125 and 126 denoting steps that were only briefly referred to previously. It is believed obvious from the flowchart set forth in FIGS. 3A and 3B that the programmed shut down sequence represented by block 125 is tied to decision steps 104 and 107. In other words, as now believed evident, there are the automatically achieved shut downs where proper operating conditions are not met, as well as the manually initiated shut down just alluded to.

In summary, it can be emphasized that the T-network 50 constantly matches the driver-to-load impedance thereby eliminating driver stress or current overloading.

Additionally, the frequency or repetition rate of each ballast circuit is automatically shifted or manipulated in a stepwise manner so as to produce a minimum stress of each lamp 18, at the same time avoiding acoustical resonance in each lamp 18. More specifically, the T-network 50, either with or without the capacitor 58 connecter therein, has the effect of allowing the lamp 18 to function under both short circuit conditions and normal load conditions.

The optimization realized via the T-network 50 permits components to be used that are less expensive, for a relatively large latitude is permitted with respect to tolerance.

The temperature and light monitoring renders a ballast of the type herein described particularly suited for installation in growth chambers involving the use of artificial light, supplemented by natural light.

In conclusion, it will be recognized that the lamp operation is indeed optimal, the use of stepped frequencies in association with the constantly adjusted T-network 50 enabling a maximum efficiency to be realized in the transmitting of power from the driver comprised of the semiconductor switches 43, 44 to the lamp 18.

I claim:

1. In a chamber for growing plants having at least one high intensity discharge lamp, means for supplying current pulses having an alternating polarity to said lamp for providing light beneficial to the growth of said plants, first means including a sensor providing a signal having a value representative of the current flowing through said lamp, second means including a sensor providing a signal representative of the value of voltage across said lamp, a microprocessor responsive to said first and second means for correlating the values of both said current and voltage to regulate the power to said lamp and thereby control the lamp's operation by controlling the amount of power supplied to said lamp by said pulse supplying means, and third means having a sensor providing a signal having a value representative of the temperature of said means for supplying current pulses, the value of said temperature signal being correlated by said microprocessor with the values of said current and voltage signals to thereby additionally control said lamp in accordance with the temperature of said means for supplying current pulses.

2. In a circuit having at least one high intensity discharge lamp, power means for supplying electrical pulses having an alternating polarity to said lamp, means for controlling said power means to provide a relatively high frequency or repetition rate of said pulses when starting said lamp, and means responsive to current flowing through said lamp for causing said controlling means to abruptly reduce said frequency after said lamp has been started.

3. The combination of claim 2 in which said controlling means includes a microprocessor.

4. The combination of claim 2 including variable inductance means between said power means and said lamp through which said electrical pulses flow, and means for reducing the value of inductance provided by said inductance means after said lamp has been started.

5. The combination of claim 4 in which said means for reducing the value of inductance includes a microprocessor.

6. The combination of claim 5 in which said variable inductance means includes a saturable core reactor having a power winding and a control winding, said microprocessor reducing the value of inductance via said control winding.

7. The combination of claim 6 in which said variable inductance means includes a T-network comprised of two inductance legs and a capacitance leg.

8. The combination of claim 7 in which one of said inductance legs includes first and second coils or windings connected in parallel with each other.

9. The combination of claim 8 including a primary coil or winding inductively associated with said first coil or winding to form a step-up transformer, a normally open switch between said power means and said primary coil or winding, said microprocessor controlling said switch to cause a high voltage spike to be applied to said lamp to start said lamp.

10. The combination of claim 8 including a control coil or winding inductively associated with said second coil or winding to form a saturable core reactor, said second coil or winding constituting the power winding for said saturable core reactor and said microprocessor varying the energization of said control winding to regulate the flow of current through said lamp.

11. In a chamber for growing plants, a plurality of high intensity lamps, a microprocessor associated with each lamp and responsive to both lamp current and lamp voltage for controlling the power to each lamp, respective means for supplying current pulses having an alternating polarity to each lamp, each of said microprocessors determining the frequency of said pulses, and a computer for exercising supervisory control over each microprocessor.

12. The combination of claim 11 in which each of said microprocessors changes the frequency of the pulses supplied to the lamp with which it is associated in a step-wise manner to avoid resonance.

13. A circuit comprising a plurality of high intensity lamps, means for supplying current pulses having an alternating polarity to each lamp, said current pulses determining the lamp load in each instance, a microprocessor for controlling the load of each lamp, each of said microprocessors determining the frequency of the pulses supplied to the lamp with which it is associated and changing the frequency of said pulses in a step-wise manner, a saturable core reactor for each lamp, each saturable core reactor having a power winding in circuit with the lamp with which it is associated and a control winding energized via the particular microprocessor for controlling the load of the lamp with which it is associated, and a computer for exercising supervisory control over each microprocessor to cause said respective loads to be simultaneously increased or decreased.

14. The combination of claim 13 in which each of said power windings is included in a T-network, said T-network in each instance comprising said power winding as a first inductance coil in one leg thereof, a second inductance coil in series with said first coil and thus in a second leg of said T-network, and a capacitor electrically connected between the junction of said coils and ground and thus in a third leg of said T-network, one side of each lamp being connected to the end of said first coil remote from said junction and the other side of each lamp being connected to ground.

15. The combination of claim 14 including a switch in circuit with said capacitor, said switch being controlled by the microprocessor with which said T-network is associated, said switch being opened by said microprocessor when the lamp in circuit with said T-network is started and closed by said microprocessor after a predetermined lamp current flow has been established.

16. The combination of claim 14 including a third inductance coil in parallel with said first inductance coil and hence also in said one leg of said T-network, and a primary winding inductively associated with said third inductance coil, said third inductance coil constituting a secondary winding of a step-up transformer for applying a high voltage spike to the lamp with which it is associated.

17. The combination of claim 16 in which the energization of the primary winding of each step-up transformer is controlled by the microprocessor with which the particular step-up transformer is associated.

18. A circuit for controlling the operation of a high intensity discharge lamp comprising a high intensity discharge lamp, power means for supplying current pulses having an alternating polarity, inductance means connected between said power means and said lamp, means for sensing the flow of current through said lamp, and means responsive to a signal derived from said current sensing means for step-wise changing the frequency of said alternating current pulses supplied by said power means to avoid resonance and to cause said power means to supply a constant amount of power to said lamp.

19. The combination of claim 18 in which said responsive means varies the frequency of said alternating current pulses in steps until substantially a peak lamp current results.

20. The combination of claim 18 in which said responsive means varies the frequency of said alternating current pulses to maintain a peak or a maximum current flow through said lamp.

21. The combination of claim 18 or 19 including means connected to said power means for initially impressing a high starting voltage across said lamp, said responsive means varying said frequency only after said current sensing means has sensed a flow of current through said lamp.

22. The combination of claim 21 in which said responsive means causes said power means to provide a relatively high frequency for a period of time after said sensing means senses current flowing through said lamp.

23. The combination of claim 22 in which said initially relatively high frequency is reduced in steps as said current through said lamp increases.

24. The combination of claim 23 in which said responsive means includes a microprocessor.

25. A lamp ballast circuit comprising a high intensity discharge lamp, power means for supplying electrical pulses of alternating polarity to said lamp, variable inductance means between said power means and said lamp through which said electrical pulses flow, means for increasing the inductance of said inductance means when starting said lamp, means for also increasing the frequency of said pulses when starting said lamp, and means for reducing the frequency of said pulses after said lamp has started.

26. The combination of claim 25 in which said means for reducing the frequency is responsive to current flow through said lamp.

27. A lamp ballast circuit comprising a high intensity discharge lamp, power means for supplying electrical pulses of alternating polarity to said lamp, variable inductance means between said power means and said lamp through which said electrical pulses flow, means for increasing the inductance of said inductance means when starting said lamp, means for also increasing the frequency of said pulses when starting said lamp, and means responsive to current flow through said lamp for reducing the frequency of said pulses after said lamp has started, said frequency reducing means including a microprocessor.

28. The combination of claim 12 including means for applying a high voltage spike to said lamp when starting said lamp, and means responsive to current flow through said lamp for inactivating said high voltage applying means.

29. The combination of claim 28 including a microprocessor, said means responsive to current flow through said lamp causing said high voltage applying means to be inactivated via said microprocessor.

30. The combination of claim 29 in which said microprocessor receives signal from said current responsive means, said microprocessor regulating the current flowing through said lamp in accordance with the value of said signal.

31. A lamp ballast circuit comprising a high intensity discharge lamp, power means for supplying current pulses of alternating polarity, a T-network including first, second and third impedance legs, said first leg having a first inductance coil, said second leg having a second inductance coil in parallel with the third inductance coil, said third leg having a capacitor with one side of said capacitor being connected to the junction of said coils, a first control winding inductively associated with said second coil, a second control winding inductively associated with said third coil, a microprocessor for energizing said first control winding to provide a high voltage to said lamp to effect ionization thereof, and means responsive to current flow through said lamp after ionization for causing said microprocessor to de-energize said first control winding and to energize said second control winding to control the flow of current through said lamp.

32. The combination of claim 31 in which said microprocessor also controls said power means to supply current pulses at a relatively high rate during ionization of said lamp, said microprocessor stepping said relatively high rate to a lower rate after ionization has occurred.

33. The combination of claim 32 including a switch connected between the other side of said capacitor and ground, one side of said lamp being connected to said second leg and the other side of said lamp to ground, said microprocessor opening said switch to remove said capacitor from said third leg during initial ionization of said lamp and to close said switch after ionization has occurred.

34. A lamp ballast circuit comprising a high intensity discharge lamp, power means for supplying electric pulses of alternating polarity, inductance means between said power means and lamp, a first winding associated with said inductance means for applying a high voltage spike to said lamp to start said lamp, current sensing means, means controlled by said current sensing means for de-energizing said first winding, means for initially causing said power means to supply electric pulses to said lamp at a relatively high frequency, means responsive to lamp current for causing said power means to supply electric pulses to said lamp at a relatively low frequency, a second winding associated with said inductance means for controlling the inductance of said inductance means to regulate the width of said electric pulses by controlling the inductance of said inductance means.

35. The combination of claim 34 in which said means for initially causing said power means to supply electric pulses at a relatively high frequency includes a microprocessor.

36. The combination of claim 35 in which the energization of said first and second windings are controlled by said microprocessor.

37. The combination of claim 35 including temperature responsive means for inactivating said power means to terminate the supply of electric pulses to said lamp when the temperature of said lamp reaches a predetermined value, said lamp temperature responsive means acting via said microprocessor to inactivate said power means.

38. A method of controlling the operation of a high intensity discharge lamp comprising the steps of initially supplying current pulses of alternating polarity to a lamp at one frequency, adjusting the amount of inductance to control the supply of current pulses to said lamp, deriving a signal representative of the current flowing through the lamp at any given moment and utilizing said signal in continuously controlling the frequency in a step-wise manner to assure that acoustical resonance is at all times avoided.

39. The method of claim 38 including the step of utilizing said signal in adjusting the width of said current pulses.

40. The method of claim 39 in which the width of said current pulses is adjusted to produce a maximum power transfer to the lamp.

41. The method of claim 39 in which the width of said current pulses is adjusted to produce a constant power transfer to the lamp.

42. A method of controlling the operation of a high intensity discharge lamp or the like in which current pulses of alternating polarity are supplied through a matching impedance network, a pair of inductances in series with said lamp through which said pulses are supplied and a capacitor in parallel with said lamp, said capacitor being connected to the juncture of said inductances, the method comprising the steps of adjusting the frequency at which said pulses are supplied so as to achieve a predetermined control of said impedance network, varying the magnitude of one of said inductances, deriving a signal representative of the current through said lamp after ionization thereof, in using said signal to adjust the frequency at which said pulses are supplied to avoid electrical resonance in said network and to avoid acoustical resonance in said lamp.

43. The method of claim 42 including the step of using said signal to continually vary the impedance of one of said inductances in accordance with the magnitude of said signal.

44. The method of claim 43 in which said signal is varied to provide a maximum transfer of power to said lamp.

45. The method of claim 43 in which said signal is varied to provide a constant transfer of power to said lamp.

46. The method of claim 45 in which said signal is varied so as to provide a transfer of maximum power to said lamp immediately after ionization has occurred in said lamp, and to provide a reduced but constant transfer of power to said lamp after said lamp has reached a predetermined temperature.

47. In a chamber for growing plants having at least one high intensity discharge lamp, means for supplying current pulses having an alternating polarity to said lamp for providing light beneficial to the growth of said plants, first means including a sensor providing a signal having a value representative of the current flowing through said lamp, second means including a sensor providing a signal representative of the value of voltage across said lamp, a microprocessor responsive to said first and second means for correlating the values of both said current and voltage to regulate the power to said lamp and thereby control the lamp's operation by controlling the amount of power supplied to said lamp by said pulse supplying means, and third means having a sensor providing a signal representative of the temperature of said lamp the value of said temperature signal being correlated by said microprocessor with the values of said current and voltage signals to thereby additionally control said lamp in accordance with the temperature of said lamp.

* * * * *

UNITED STATES PATENT AND TRADEMARK OFFICE

CERTIFICATE OF CORRECTION

PATENT NO. : 4,396,872

DATED : August 2, 1983

INVENTOR(S) : Charles G. Nutter

It is certified that error appears in the above-identified patent and that said Letters Patent are hereby corrected as shown below:

Col. 12, line 32; "the ine 72a" should be --- the line 72a ---;

line 58; "sensores" should be --- sensors ---.

Col. 16, line 33; "claim 18 or 19" should be --- claim 19 or 20 ---.

Col. 17, line 6; "claim 12" should be --- claim 27 ---.

Signed and Sealed this

*Sixth* Day of *December 1983*

[SEAL]

*Attest:*

GERALD J. MOSSINGHOFF

*Attesting Officer*

*Commissioner of Patents and Trademarks*